US007922225B2

(12) United States Patent
Li

(10) Patent No.: US 7,922,225 B2
(45) Date of Patent: Apr. 12, 2011

(54) SERVING TONGS

(76) Inventor: Kwong Fat Li, Minnetonka, MN (US)

( * ) Notice: Subject to any disclaimer, the term of this patent is extended or adjusted under 35 U.S.C. 154(b) by 310 days.

(21) Appl. No.: 12/335,170

(22) Filed: Dec. 15, 2008

(65) Prior Publication Data

US 2009/0243317 A1 Oct. 1, 2009

(30) Foreign Application Priority Data

Mar. 29, 2008 (CN) ..... 2008 2 0009327 U

(51) Int. Cl.
*A47G 21/10* (2006.01)

(52) U.S. Cl. ..... 294/3; 294/16; 294/99.2

(58) Field of Classification Search ..... 294/3, 16, 294/99.2
See application file for complete search history.

(56) References Cited

U.S. PATENT DOCUMENTS

| | | | | | |
|---|---|---|---|---|---|
| 2,362,395 | A * | 11/1944 | Ozdobinski | 294/33 |
| 5,199,756 | A * | 4/1993 | Bartlett et al. | 294/16 |
| 5,934,721 | A * | 8/1999 | Walde | 294/3 |
| 6,089,631 | A * | 7/2000 | Thurlow et al. | 294/16 |
| D477,504 | S * | 7/2003 | Rowe et al. | D7/686 |
| 7,261,348 | B1 * | 8/2007 | Fried | 294/16 |

* cited by examiner

*Primary Examiner* — Saúl J Rodríguez
*Assistant Examiner* — Stephen Vu
(74) *Attorney, Agent, or Firm* — Dicke, Billig & Czaja, PLLC

(57) ABSTRACT

Serving tongs that include handles are movable with respect to each other. The serving tongs include a cutting mechanism, a scooping mechanism, and a locking mechanism.

9 Claims, 1 Drawing Sheet

SERVING TONGS

CLAIM TO PRIORITY

Figure 1:
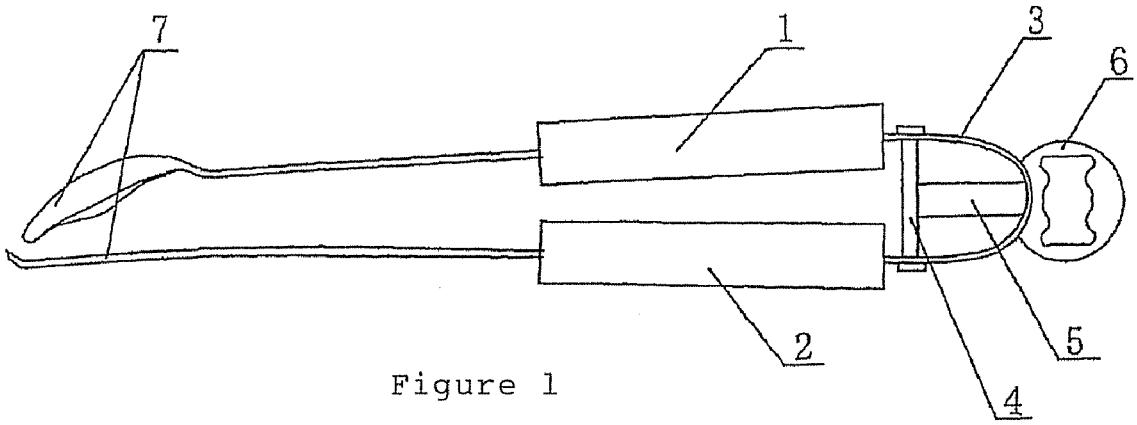

The present application claims the benefit and priority under 35 U.S.C. 119(a) from a co-pending Chinese patent application having Serial Number 200820009327.5 filed in China on Mar. 29, 2008, the disclosure of which is hereby incorporated by reference in its entirety.

TECHNOLOGICAL INNOVATIONS

This new device is a type of eating utensil, and/or specifically, is a type of serving tongs.

TECHNICAL BACKGROUND

Serving tongs are an essential eating utensil in our daily lives. The use of serving tongs, especially at parties, is a convenient, clean and hygienic way of serving food. Most of the serving tongs nowadays have two handles, with the clamp located at the ends of the handles, and the open-close functions of the clamp are achieved through a spring mechanism at the other end. However, the clamping force in the existing tongs comes from the user. If the user's hand is not agile or strong enough, the food will not be securely clamped. This problem is especially pronounced under such environmental conditions as cold weather, or usage by elderly people.

DETAILS OF THE INVENTION

The objective of this new invention is to address the shortcomings of existing technology, in order to provide a set of serving tongs with a simple construction, that would allow the user to clamp the food securely, even if the user is no longer strong enough to provide the clamping force.

This new invention features the following technological improvements:

The new design is a type of serving tongs, which consist of Handle No. 1 and Handle No. 2, as well as the Clamp, which is connected to each end of these handles. The ends of Handle No. 1 and Handle No. 2 are joined together via an arc-shaped spring clip connection. There are two guiding grooves, one on each side of this arc-shaped spring clip, adjoining each end of Handles No. 1 and 2. There is a moving control mechanism between the two guiding grooves, which is designed to slide up and down the two guiding grooves; and the outer dimensions of the moving control mechanism, which includes the ends extending through the guiding grooves, is bigger than the width between the guiding grooves.

The abovementioned moving control mechanism consists of a set of perpendicular T-bars, comprising the first rod and the second flat metal strip; the first rod moves inside the guiding grooves on the arc-shaped spring clip. One end of the flat metal strip is permanently attached to the center of the rod, while the other end of the metal strip protrudes outside through a slot-through hole located in the top center of the arc-shaped spring clip.

The length of the first rod in the abovementioned moving control mechanism is the same as the biggest distance between the two guiding grooves located on the arc-shaped spring clip, when the clamp is in the closed position.

A slotted-through hole is located at the top center of the abovementioned arc-shaped spring clip, through which the second flat metal strip of the moving control mechanism can pass through.

The second flat metal strip of the abovementioned moving control mechanism extends outside of the arc-shaped spring clip and connects to a push-pull ring The abovementioned push-pull ring serves as a bottle-opener.

One arm of the above-mentioned clamp serves as a spatula and the other arm serves as a seasoning spoon.

One side of the abovementioned spatula has a saw-teeth edge, which serves as a cutting knife.

A unique locking mechanism would allow the clamp to be locked at various intermediate positions between the fully open and closed positions, as needed for serving and cooking purposes.

The most beneficial features of this new device are that, through the integrated operation of the guiding grooves on the arc-shaped spring clip and the moving control mechanism, and the locking mechanism which enables the clamp to be locked, which allow the user to clamp the food securely, even if the user is no longer strong enough to provide the clamping force. In addition, this device is collapsible and easy to carry around, and saves storage space. It is also a very practical design, as the multi-purpose design of the clamp and push-pull ring saves the user the trouble of having to carry a variety of cooking utensils.

ILLUSTRATIONS

FIG. 1—The elevation construction view of this new device

Figure 2:
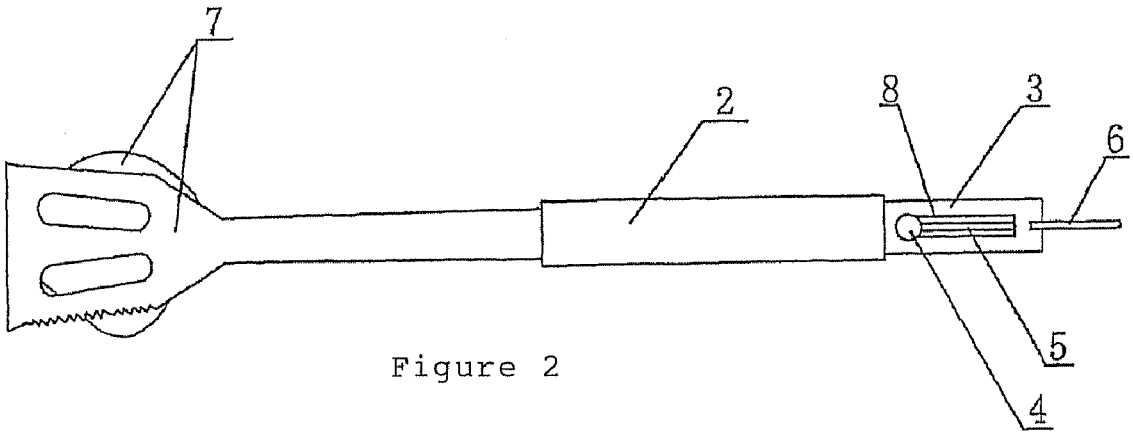

FIG. 2—The plan view of this new device

Figure 3:
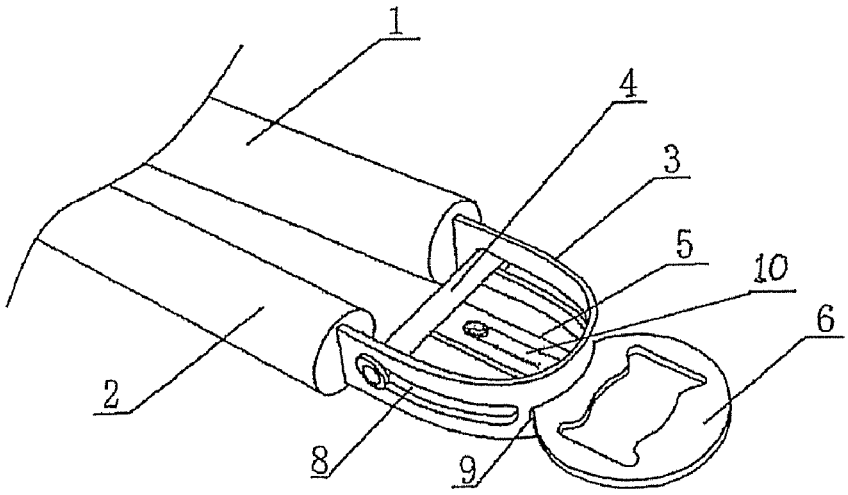

FIG. 3—The blow-up 3-dimensional construction view of the arc-shaped spring clip.

The following describes how the device works:

Please refer to the illustrations when reading the following detailed descriptions.

As shown in FIGS. 1 and 2, the new device is a type of serving tongs, consisting of Handle No. 1 (1) and Handle No. 2 (2), as well as the Clamp (7), which is connected to each end of these handles. Handle No. 1 and Handle No. 2 are joined together via an arc-shaped spring clip (3) connection. There are two guiding grooves (8), one on each side of this arc-shaped spring clip (3), adjoining each end of Handles No. 1 and 2. There is a moving control mechanism between the two guiding grooves (8), which is designed to slide up and down the two guiding grooves (8). The outer dimensions of the ends of the moving control rod (4), which includes the ends extending through the guiding grooves, is bigger than the width between the guiding grooves, so as to keep the rod (4) I position.

As shown in FIG. 3, the abovementioned moving control mechanism consists of a set of perpendicular T-bars, comprising the first rod (4) and the second flat metal strip (5). The first rod (4) moves inside the guiding grooves (8) on the arc-shaped spring clip (3); one end of the flat metal strip (5) is permanently attached to the center of the rod (4), while the other end of the metal strip (5) protrudes outside through a slot-through hole located in the top center of the arc-shaped spring clip. In order to achieve this control effect, a slotted-through hole (9) is located at the top center of the abovementioned arc-shaped spring clip (3), through which the second flat metal strip (5) of the moving control mechanism can pass through.

To achieve the clamping capability when the clamp is closed, the length of the first rod (4) in the abovementioned moving control mechanism is the same as the biggest distance between the two guiding grooves located on the arc-shaped spring clip (3), when the clamp (7) is in the closed position.

In order to facilitate the maneuvering of the T-control device, the second flat metal strip (5) of the abovementioned moving control mechanism extends outside of the arc-shaped spring clip (3) and connects to a push-pull ring (6). The user can extend his or her finger through the push-pull ring (6), to make it even easier to maneuver the moving control mechanism. The push-pull ring (6) serves as a bottle-opener, thus adding to the device's capabilities.

In order to enable the clamp (7) to function smoothly in the fully open position, an offset slit in the middle of the flat metal strip (5) creates friction to prevent the T-control mechanism to slide into the grooves due to gravity. This design feature also serves as a locking mechanism, to enable the clamp (7) to be locked at various preferred intermediate positions between the fully open and closed positions.

Furthermore, as an added improvement in the device, one arm of the clamp (7) serves as a spatula, and the other arm serves as a seasoning spoon. At the same time, one side of the spatula has a saw-teeth edge, which serves as a cutting knife. Thus this multi-purpose device can be used to stir-fry, flip over food as well as for cutting foods.

The Working Principles

Since the curvature of the arc-shaped spring clip (3), which is located between the Handle No. (1) and a Handle No. (2), varies along its length, the distance between the ends of each curvature along the arc varies too. The closer to the top of the curvature, the distance between the ends is smaller. The guiding groves (8) on both sides of the arc-shaped spring clip (3) form a key component in the control mechanism. The length of the moving rod (4) is fixed, which equals to the longest distance between the guiding groves (8) at the completely closed positions of clamp (7). Since the arc-shaped spring clip (3) is an expansion spring, while the moving rod (4) travels down the guiding groves (8) from the middle section down to the ends of the arc-shaped spring clip (3), the arc-shaped spring clip (3) is under the compression force. The arc-shaped spring clip (3) will expand or contract according to the moving direction of rod (4). In other words, the fixed length of the rod (4) has the effect to change the curvature or shape of the arc-shaped spring clip, hence changes the distance between the opening widths of the clamp (7). When the control rod (4) is fully pushed to the lowest position in the guiding grove, the clamp (7) is in the complete close position. The integrated locking mechanism is able to lock the position of the arc-shaped spring. This will maintain the device in a steady clamping position.

In order for this device to work effectively at various preferred intermediate positions between the fully open and closed locations of the clamp (7), the off set slit (10) in the middle of the flat metal strip (5) creates friction with the slotted through hole (9) to prevent the rod (4) from dropping down the guiding groves due to gravity, which enables the device to hold steadily at various opening positions as desired in operation.

The invention claimed is:

1. Serving tongs consisting a first handle (1) and a second handle (2), as well as a clamp (7), connecting to each end of the handles, the first handle (1) and the second handle (2) are joined together via an arc-shaped spring clip (3) connection having two guiding grooves (8), one on each side of the arc-shaped spring clip (3), wherein a moving control mechanism adjoining each of the ends of the first and second handles between the two guiding grooves for sliding up and down the two guiding grooves (8); outer dimensions of a moving control rod (4), including a pair of ends having a larger width than the guiding grooves and extending through the guiding grooves, wherein the moving control mechanism consists of a T-bar comprising the moving control rod (4) and a flat metal strip (5); the moving control rod (4) moves inside the guiding grooves (8) on the arc-shaped spring clip (3); one end of the flat metal strip (5) is permanently attached to the center of the moving control rod (4), while the other end of the flat metal strip (5) protrudes outside through a slot-through hole located in a top center of the arc-shaped spring clip.

2. The serving tongs, as described in claim 1, wherein the length of the moving control rod (4) is the same as a maximum distance between the two guiding grooves located on the arc-shaped spring clip (3), when the clamp (7) is in the closed position.

3. The serving tongs, as described in claim 1, wherein a slotted-through hole (9) is located at a top center of the arc-shaped spring clip (3), through which the second flat metal strip (5) of the moving control mechanism can pass through.

4. The serving tongs, as described in claim 1, wherein the second flat metal strip (5) of the moving control mechanism extends outside of the arc-shaped spring clip (3) and connects to a push-pull ring (6).

5. The serving tongs, as described in claim 4, wherein the push-pull ring (6) serves as a bottle-opener.

6. The second flat metal strip (5), as described in claim 1, wherein an offset slit (10), which is built in the second flat metal strip (5), has a spring effect that creates friction between the second flat metal strip (5) and a slotted-through hole (9), which keeps the rod (4) from sliding down the guiding grooves (8), when the Clamp (7) is in a fully open position.

7. The serving tongs according to claim 1, integrated operations of the first rod (4) and the second flat metal strip (5), as well as an offset slit (10) and the guiding grooves, are so designed as to enable the clamp (7) to be locked at various preferred intermediate positions between fully open and closed positions.

8. Serving tongs consisting a first handle (1) and a second handle (2), as well as a clamp (7), each connecting to each end of the handles, are: the first handle (1) and the second handle (2) are joined together via an arc-shaped spring clip (3) connection having two guiding grooves (8), one on each side of this arc-shaped spring clip (3), wherein a moving control mechanism adjoining each of the ends of the first and second handles between the two guiding grooves for sliding up and down the two guiding grooves (8); and an a moving control rod (4) including a pair of ends having a larger width than the guiding grooves and extending through the guiding grooves, wherein one of the clamps has as a spatula shape and another of the clamps has a seasoning spoon shape.

9. The serving tongs, as described in claim 8, wherein one side of the spatula has a saw-teeth edge, which serves as a cutting knife.

* * * * *

UNITED STATES PATENT AND TRADEMARK OFFICE

CERTIFICATE OF CORRECTION

PATENT NO. : 7,922,225 B2
APPLICATION NO. : 12/335170
DATED : April 12, 2011
INVENTOR(S) : Kwong Fat Li It is certified that error appears in the above-identified patent and that said Letters Patent is hereby corrected as shown below:

In Foreign Application Priority Data, insert --.5-- after "200820009327"

In Abstract, "Serving tongs that include handles are movable with respect to each other. The serving tongs include a cutting mechanism, a scooping mechanism, and a locking mechanism" has been replaced with --Serving tongs that include two handles and a clamp. The handles are joined together via an arc-shaped spring clip connection. There are two guiding grooves, one on each side of this arc-shaped spring clip. There is a moving control mechanism between the two guiding grooves, which is designed to slide up and down the two guiding grooves. An outer dimension of the moving control rod, which includes ends extending through the guiding grooves, is bigger than a width of the guiding grooves. One arm serves as a spatula and another arm serves as a seasoning spoon.- -

Column 4, line 5, delete "outer dimension of".

Column 4, line 51, delete "an".

Signed and Sealed this
Twenty-eighth Day of June, 2011

David J. Kappos

David J. Kappos
*Director of the United States Patent and Trademark Office*